US009909365B2

(12) United States Patent
Lin et al.

(10) Patent No.: US 9,909,365 B2
(45) Date of Patent: Mar. 6, 2018

(54) DOWNHOLE TOOLS HAVING MECHANICAL JOINTS WITH ENHANCED SURFACES

(75) Inventors: Chih Lin, Spring, TX (US); Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 118 days.

(21) Appl. No.: 13/098,158

(22) Filed: Apr. 29, 2011

(65) Prior Publication Data

US 2012/0273282 A1 Nov. 1, 2012

(51) Int. Cl.
*E21B 10/22* (2006.01)
*E21B 4/02* (2006.01)
*E21B 43/12* (2006.01)

(52) U.S. Cl.
CPC ..... *E21B 10/22* (2013.01); *E21B 4/02* (2013.01); *E21B 43/128* (2013.01)

(58) Field of Classification Search
CPC ..... E21B 10/22; E21B 10/46; E21B 10/50; E21B 4/003
USPC ..... 175/327, 372, 425, 92, 57
See application file for complete search history.

(56) References Cited

U.S. PATENT DOCUMENTS 4,976,324 A 12/1990 Tibbitts
5,161,898 A * 11/1992 Drake ..... 384/95
5,791,421 A 8/1998 Lin
6,045,029 A 4/2000 Scott et al.
6,135,218 A 10/2000 Deane et al.
6,338,901 B1 * 1/2002 Veerasamy ..... B05D 5/083 428/336
6,450,271 B1 * 9/2002 Tibbitts et al. ..... 175/374
6,543,132 B1 4/2003 Krueger et al.
7,160,616 B2 1/2007 Massler et al.
7,234,541 B2 6/2007 Scott et al.
7,841,395 B2 11/2010 Gay et al.
8,691,063 B2 * 4/2014 Aleksandrov ..... 204/298.14
2004/0031624 A1 2/2004 Scott et al.
2006/0243494 A1 * 11/2006 Koltermann ..... E21B 10/25 175/228
2008/0202814 A1 8/2008 Lyons et al.
2008/0236842 A1 10/2008 Bhavsar et al.
2009/0038858 A1 * 2/2009 Griffo et al. ..... 175/371
2009/0194339 A1 * 8/2009 Dick et al. ..... 175/371
(Continued)

FOREIGN PATENT DOCUMENTS

WO WO2008099220 8/2008

OTHER PUBLICATIONS

Walker, Chris, Diamond Coatings are Branching Out, www.Physicsworld.com,, Jul. 31, 2009, 2 pages.
(Continued)

*Primary Examiner* — Caroline N Butcher
(74) *Attorney, Agent, or Firm* — TraskBritt

(57) ABSTRACT

A downhole tool comprises a mechanical joint, and a diamond-like coating over at least a portion of a surface of at least one component of the mechanical joint, the diamond-like coating having a thickness greater than 10 micrometers. Methods of manufacturing a mechanical joint of a downhole tool comprise disposing a diamond-like coating on at least a portion of a surface of a component of the mechanical joint of the downhole tool to a thickness of at least 10 microns and at a temperature less than about 200° C.

7 Claims, 7 Drawing Sheets

(56) References Cited

U.S. PATENT DOCUMENTS

| | | | | |
|---|---|---|---|---|
| 2009/0321146 | A1 | 12/2009 | Dick et al. | |
| 2010/0012391 | A1 | 1/2010 | Shamburger | |
| 2010/0038142 | A1 | 2/2010 | Snyder et al. | |
| 2010/0044110 | A1* | 2/2010 | Bangru et al. | 175/61 |
| 2010/0108403 | A1 | 5/2010 | Keshavan | |
| 2010/0178436 | A1* | 7/2010 | Aleksandrov | 427/569 |
| 2011/0048810 | A1 | 3/2011 | Lin et al. | |
| 2011/0220415 | A1* | 9/2011 | Jin | C23C 14/024 175/57 |
| 2012/0080230 | A1* | 4/2012 | Flores | E21B 10/23 175/57 |

OTHER PUBLICATIONS

Scott, Danny E., U.S. Appl. No. 61/355,015 entitled, Methods of Enhancing Erosion, Abrasion and Corrosion Resistance of, Coef-fcient Material of Friction of, and Reducing Material Adhesion to, Cutting Element Surfaces and Resulting Cutting Elements, filed Jun. 15, 2011.

Scott, Danny E., U.S. Appl. No. 61/355,019 entitled, Methods of Enhancing Erosion and Abrasion Resistance of, and Reducing Material Adhesion to, and Coefficient of Friction of, Earth-Boring Tool Surfaces and Resulting Earth-Boring Tools, filed Jun. 15, 2011.

International Search Report for International Application No. PCT/US2012/035388 dated Oct. 29, 2012, 3 pages.

International Written Opinion for International Application No. PCT/US2012/035388 dated Oct. 29, 2012, 4 pages.

International Preliminary Report and Patentability for International Application No. PCT/US2012/035388 dated Oct. 29, 2013, 5 pages.

* cited by examiner

DOWNHOLE TOOLS HAVING MECHANICAL JOINTS WITH ENHANCED SURFACES

TECHNICAL FIELD

Embodiments of the present disclosure generally relate to downhole tools, such as earth-boring tools, to methods of enhancing surface characteristics and mechanical joints of such downhole tools and resulting structures.

BACKGROUND

Downhole tools for earth boring and for other purposes, including rotary drill bits, are commonly used in bore holes or wells in earth formations. One type of rotary drill bit is the roller cone bit (often referred to as a rock bit), which typically includes a plurality of conical cutting elements (often referred to as cones or cutters) secured to legs dependent from the bit body. For example, the bit body of a roller cone bit may have three depending legs each having a bearing pin (otherwise referred to as a journal pin). A rotatable cone may be mounted on each of the bearing pins. The bit body also may include a threaded upper end for connecting the drill bit to a drill string. During drilling, the rotation of the drill string and the contact of cutter elements with rock produce rotation of each cone about its associated bearing pin. The weight on the bit together with the rotation of the cones thereby causes the cutter elements to engage and disintegrate the rock.

The roller cone bit may have a sealed bearing system with grease lubrication to extend the bearing life. These bits operate in an extremely hostile environment due to high and uneven loads, elevated temperatures and pressures, and the presence of abrasive grit both in the hole cuttings and the drilling fluid. This is particularly true when drilling deep bore holes. In addition, some rock bits such as those used in geothermal exploration as well as in some hydrocarbon-bearing formations are subject to corrosive chemical environments in the form of, for example, carbon dioxide and hydrogen sulfide. When the seal is compromised, the bearing degrades rapidly due to loss of lubrication and can result in catastrophic bit failure. Another factor that can lead to early bearing failure is the inability of the bearings to withstand changes in the moment of forces directed against the roller cone. For example, the side forces (e.g., forces that may arise from eccentrically contacting one side of the bore hole) may tend to cause cone cocking or misalignment, thereby, producing high contact pressure, leading to high wear rate, and contributing to early bearing failure. The wear in the bearings will aggravate the cone misalignment and displacements and results in high seal leakage, which accelerates the degradation process. In addition, the bearing's load carrying capacity may limit both the load that can be applied to the bit as well as the angular velocity at which the bit can be rotated, thereby establishing constraints on achievable penetration rates and feasible cutter designs.

In downhole motors and submersible pumps, bearing wear is the source of significant problems. The wear is predominantly caused by third particle abrasion and erosion due to the abrasive grits present in the fluid flow.

In view of the foregoing, improved mechanical joints for downhole tools would be desirable.

BRIEF SUMMARY

In embodiments of the disclosure, a downhole tool may comprise a mechanical joint and a diamond-like coating over at least a portion of at least one surface of at least one component of the mechanical joint, the diamond-like coating having a thickness greater than 10 micrometers.

In additional embodiments of the disclosure, a method of manufacturing a mechanical joint of a downhole tool may comprise disposing a diamond-like coating on the at least a portion of at least one surface of a component of the mechanical joint of the downhole tool to a thickness of at least 10 microns and at a temperature less than about 200° C.

BRIEF DESCRIPTION OF THE SEVERAL VIEWS OF THE DRAWINGS

While the specification concludes with claims particularly pointing out and distinctly claiming that which are regarded as embodiments of the present disclosure, advantages of embodiments of the disclosure may be more readily ascertained from the description of certain example embodiments of the disclosure set forth below, when read in conjunction with the accompanying drawings.

DETAILED DESCRIPTION

Figure 1:
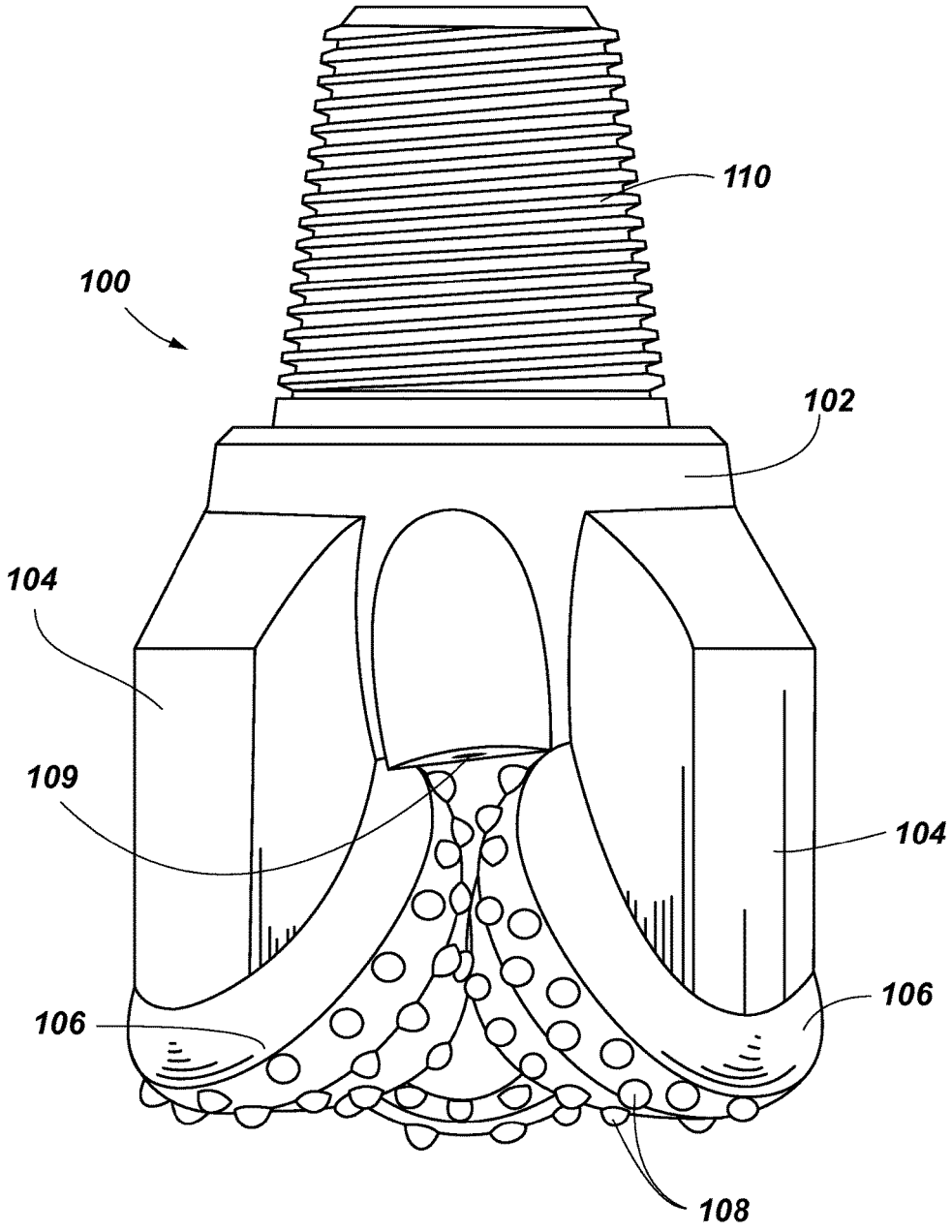
FIG. 1 shows a perspective view of a roller cone bit including mechanical joints in accordance with an embodiment of the present disclosure.

The illustrations presented herein are not meant to be actual views of any particular device, or related method, but are merely idealized representations which are employed to describe embodiments of the present disclosure. Additionally, elements common between figures may retain the same numerical designation.

Although some embodiments of the present disclosure are depicted as being used and employed in roller cone bits, persons of ordinary skill in the art will understand that the embodiments of the present disclosure may be employed in any downhole tool mechanical joint or exterior surface where improved wear resistance, improved thermal barrier, improved fluid barrier, reduced wettability by aqueous solutions, and/or a reduced coefficient of sliding friction, is desirable. Accordingly, the term "downhole tool" and as used herein, means and includes any type of tool, drill bit or other assembly for use in bore holes or wells in earth formations, including completion equipment. For example, a downhole tool may employ a component rotatable with respect to another component to which the component is coupled and used for drilling during the formation or enlargement of a wellbore in a subterranean formation and include, for example, earth-boring rotary drill bits such as roller cone bits, core bits, eccentric bits, bicenter bits, reamers, mills, hybrid bits employing both fixed and rotatable cutting structures, and other drilling bits and tools employing rotatable components, as known in the art. In some embodiments, a downhole tool may employ a component rotatable with respect to another component to which the component is mounted, regardless of whether the downhole tool directly engages, shears, cuts, or crushes the underlying earth formation, such as, for example, Moineau-type "mud" motors and turbine motors, as known to those of ordinary skill in the art. Further, embodiments of the present disclosure may be employed in components, joint members or other elements of downhole tools, such as mentioned above, that do not rotate with respect to another component. Further, embodiments of the present disclosure may be employed in components, joint members or other elements of downhole tools, such as those mentioned above, that reciprocally slide with respect to another component.

As used herein, the term "mechanical joint" means and includes an interface between two or more components of an assembly which, during use, rotate or otherwise move with respect to one another while in mutual contact. In other words, one component may move in use relative to one or more other, stationary components, or each component of the joint may move both with respect to at least one other component and with respect to another, fixed reference.

In embodiments of the disclosure, a diamond-like, vapor-deposited coating is applied to a surface or surfaces of one or more components of a downhole tool, such as to a surface or surfaces of components of a mechanical joint. The coating may be applied at temperatures as low as 100° C. or less and no more than about 200° C., and in thicknesses of from about 5 microns up to over 100 microns. The coating may enhance wear resistance, may provide a thermal barrier, may provide a fluid barrier, may reduce wettability by aqueous solutions, and may reduce a coefficient of sliding friction of the coated surface or surfaces. Additionally, the coating may increase the service life and improve the reliability of a mechanical joint of a downhole tool.

FIG. 1 is a perspective view of a downhole tool (e.g., an earth-boring rotary drill bit 100). The drill bit 100, depicted as a roller cone bit, includes a bit body 102 having three legs 104 depending from the bit body 102. A roller cone 106 is rotatably mounted to a bearing pin 116 (FIG. 2) on each of the legs 104. Each roller cone 106 may comprise a plurality of cutting inserts 108. The drill bit 100 includes a threaded section 110 at its upper end for connection to a drill string (not shown). Additionally, the drill bit 100 may have nozzles 109 for discharging drilling fluid into a borehole, which may be returned along with cuttings up to the surface during a drilling operation. In some embodiments, the earth-boring rotary drill bit 100 may include cones having teeth that are integrally formed with the body of each cone such as the earth-boring drill bits described in, for example, U.S. patent application Ser. No. 11/710,091, filed Feb. 23, 2007, the disclosure of which is hereby incorporated herein in its entirety by this reference.

Figure 2:
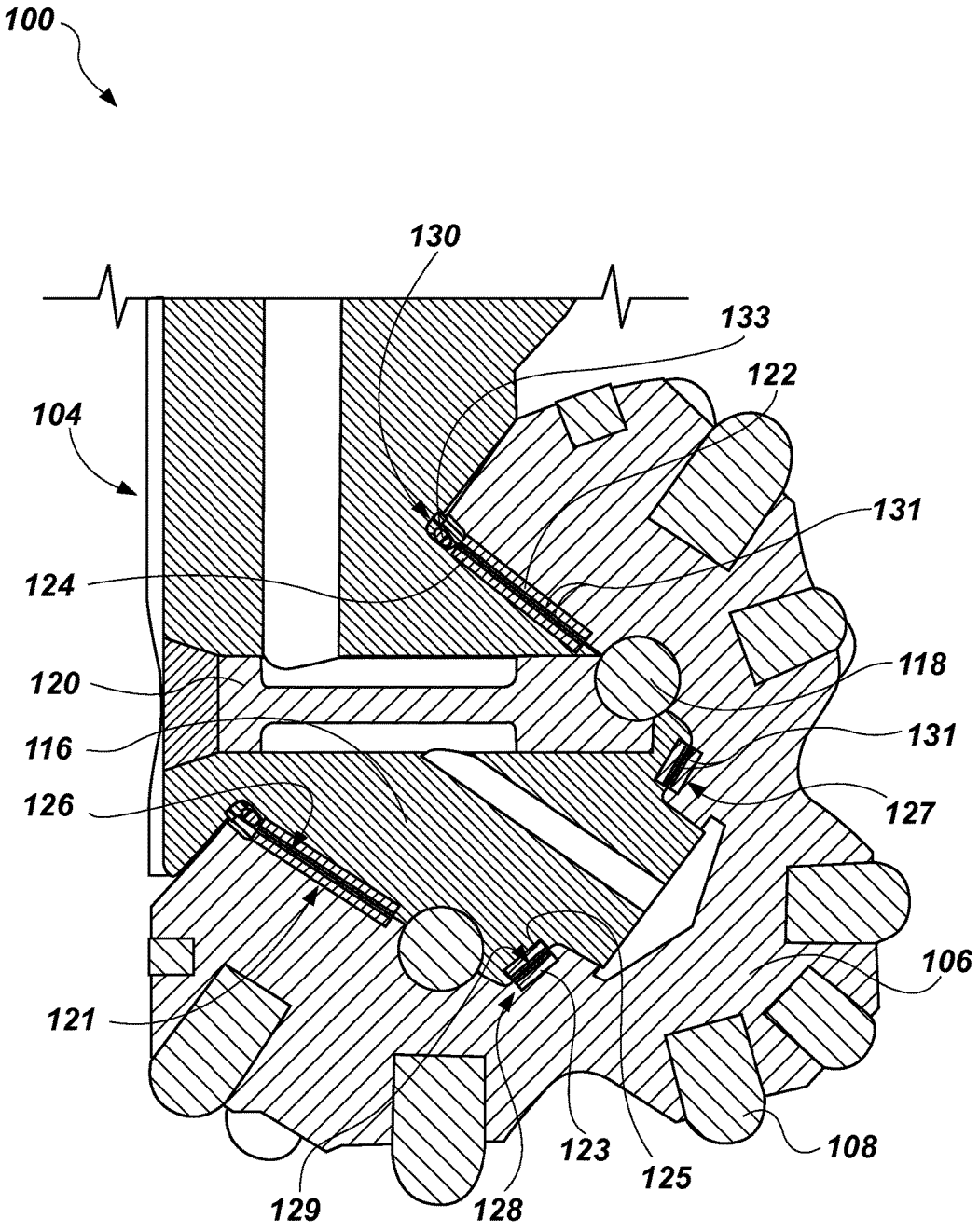
FIG. 2 shows an enlarged cross-sectional view of a portion of the roller cone bit shown in FIG. 1, including journal bearings.

FIG. 2 is a partial cut-away perspective view of an earth-boring rotary drill bit 100 similar to the drill bit 100 of FIG. 1. As shown, each roller cone 106 is rotatably mounted to a bearing pin 116. At the interface between each roller cone 106 and bearing pin 116 is a bearing assembly 128, which includes at least one radial bearing 121 and at least one axial bearing 127. The bearing assembly 128 additionally includes ball bearings 118, a ball plug or retainer 120. In some embodiments, a radial bearing 121 may comprise a radial cone bearing member 122 and a radial journal bearing member 124, and an axial bearing 127 may comprise an axial cone bearing member 123 and an axial journal bearing member 125. The radial cone bearing member 122 and radial journal bearing member 124 are configured to bear radial loads while the axial cone bearing member 123 and the axial journal bearing member 125 are configured to bear axial loads. The drill bit 100 may also include a seal assembly 130 located to seal each bearing assembly 128. For example, one or more of an elastomer seal, an elastomer seal component, and a mechanical face seal (MFS) may be provided to prevent cutting debris from entering the bearing assembly 128 and to maintain a lubricant, such as grease, within the bearing assembly 128.

In some embodiments, a near-diamond hardness coating (thickness greatly exaggerated for clarity in the drawing figures), which may also be termed a "diamond-like" coating, is included on surfaces of the bearing assembly 128. For example, surfaces of the radial cone bearing member 122, the radial journal bearing member 124, the axial cone bearing member 123, and the axial journal bearing member 125 may include a diamond-like coating 131 (FIG. 2).

Figure 3:
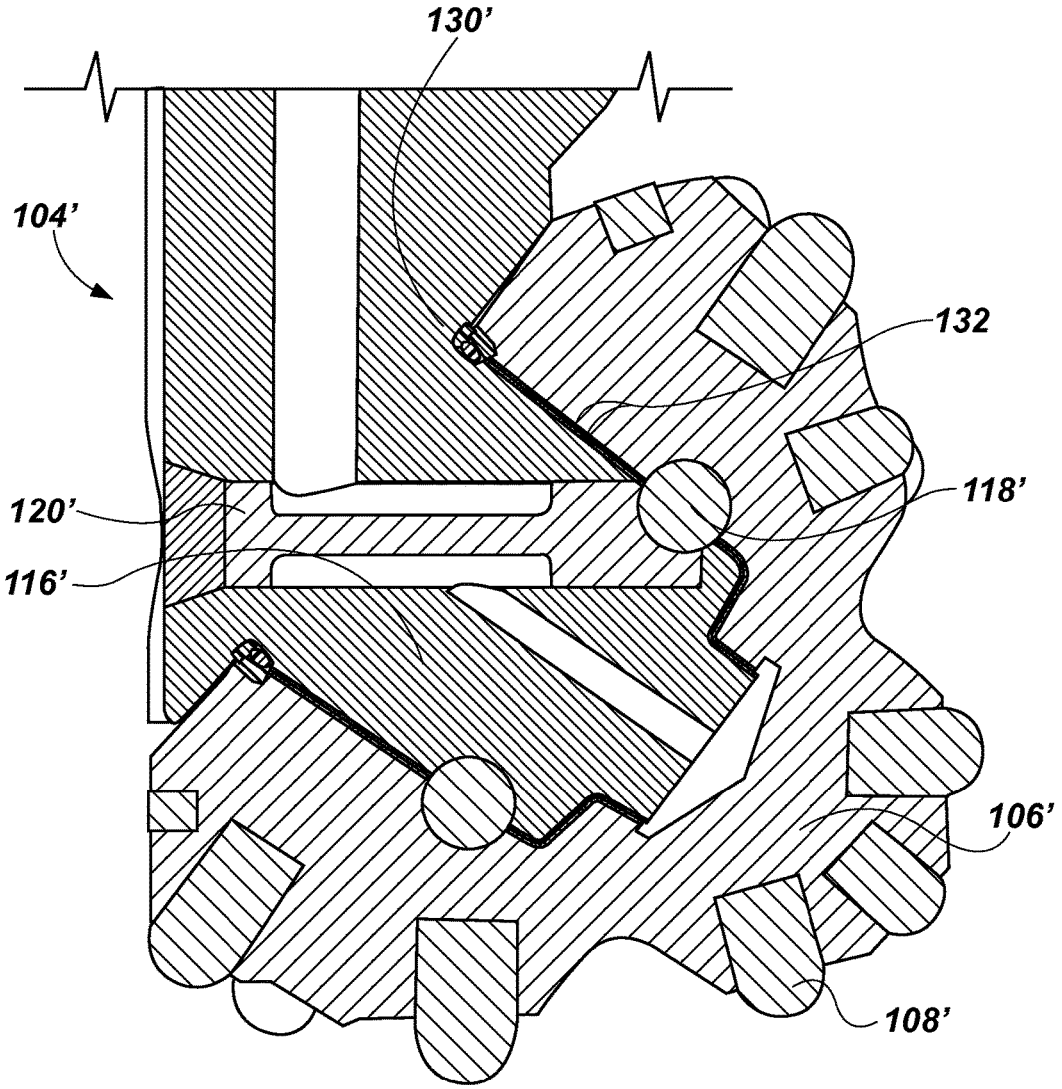
FIG. 3 shows an enlarged cross-sectional view of a portion of another roller cone bit, such as shown in FIG. 1, according to another embodiment of the disclosure.

In some embodiments, a diamond-like coating 132 may be applied directly to interior surfaces of each roller cone 106' and the exterior surfaces of each bearing pin 116' prior to assembly, such as is shown in FIG. 3. For example, a diamond-like coating 132 having a hardness of above 4,000 Vickers Hardness (HV) may be applied directly to interior surfaces of each roller cone 106' and the exterior surfaces of each bearing pin 116'. In some embodiments, the diamond-like coating 132 may have a thickness greater than 10 microns (micrometers). In further embodiments, the diamond-like coating 132 may have a thickness greater than about 50 microns. In additional embodiments, the diamond-like coating 132 may have a thickness greater than about 100 microns. Additionally, the diamond-like coating 132 on a component may exhibit a coefficient of sliding friction of about 0.07-0.08, against dry steel, or as low as about 0.035, against another diamond-like coating on another component, at a relatively high surface pressure (e.g., at surface pressures greater than about 3 GPa).

In additional embodiments, a diamond-like coating 131 may be applied to separate components, such as radial bearing inserts (e.g., the radial cone bearing member 122 and the radial journal bearing member 124) and axial bearing inserts (e.g., the axial cone bearing member 123 and the axial journal bearing member 125), which may then be joined with the roller cones 106 and the bearing pins 116 prior to the assembly thereof, such as is shown in FIG. 2. For example, a diamond-like coating 131 having a hardness of above 4,000 Vickers Hardness (HV) may be applied to the radial cone bearing member 122, the radial journal bearing member 124, the axial cone bearing member 123, and the axial journal bearing member 125. In some embodiments, the diamond-like coating 131 may have a thickness greater than 10 microns. In further embodiments, the diamond-like coating 131 may have a thickness greater than about 50 microns. In additional embodiments, the diamond-like coating 131 may have a thickness greater than about 100 microns. Additionally, the diamond-like coating 131 may exhibit a coefficient of sliding friction of about 0.07-0.08, against dry steel, or as low as about 0.035, against another diamond-like coating, at a relatively high surface pressure (e.g., at surface pressures greater than about 3 GPa).

Figure 4:
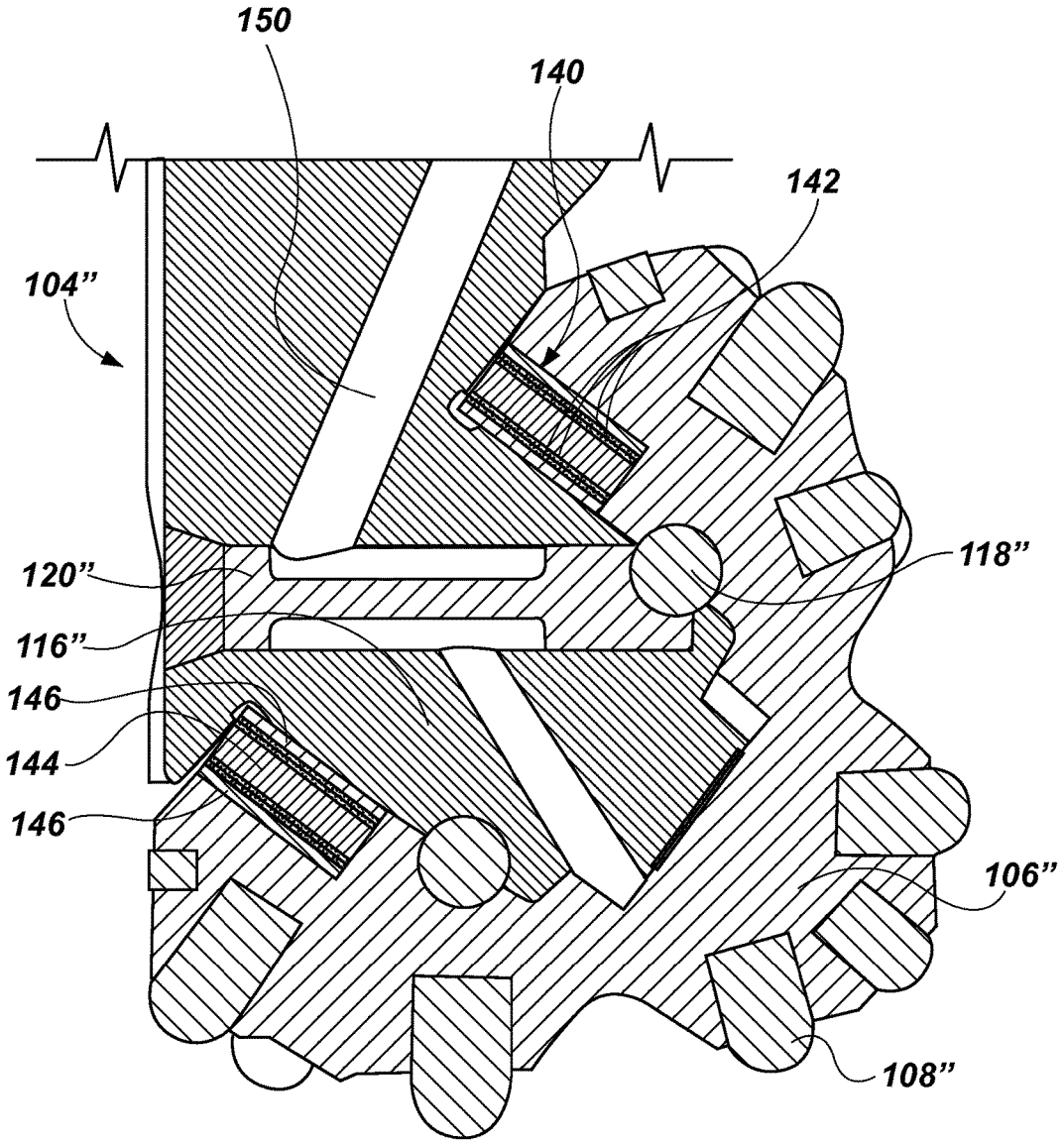
FIG. 4 shows an enlarged cross-sectional view of a portion of another roller cone bit, such as shown in FIG. 1, including roller bearings, according to another embodiment of the disclosure.

In further embodiments, a bearing assembly may include a roller bearing assembly 140, such as shown in FIG. 4, and a diamond-like coating 142 may be applied to separate components of each roller bearing assembly 140. For example, a diamond-like coating 142 having a hardness of above 4,000 Vickers Hardness (HV) may be applied to each roller 144 of each roller bearing assembly 140, and/or each bearing race 146, which may be incorporated into the bearing pins 116" and the roller cones 106" or may be separate inserts coupled thereto. In some embodiments, the diamond-like coating 142 may have a thickness greater than 10 microns. In further embodiments, the diamond-like coating 142 may have a thickness greater than about 50 microns. In additional embodiments, the diamond-like coating 142 may have a thickness greater than about 100 microns. Additionally, the diamond-like coating 142 may exhibit a coefficient of sliding friction of about 0.07-0.08, against dry steel, or as low as about 0.035, against another diamond-like coating, at a relatively high surface pressure (e.g., at surface pressures greater than about 3 GPa).

In additional embodiments, a diamond-like coating 133 may be included on surfaces of the seal assembly 130 (FIG. 2). For example, one or more of an elastomer seal, an elastomer seal component, a mechanical face seal (MFS), and another seal component may include a diamond-like coating 133. For example, the diamond-like coating 133 having a hardness of above 4,000 Vickers Hardness (HV) may be applied to surfaces of a seal assembly 130. In some embodiments, the diamond-like coating 133 may have a thickness greater than 10 microns. In further embodiments, the diamond-like coating 133 may have a thickness greater than about 50 microns. In additional embodiments, the diamond-like coating 133 may have a thickness greater than about 100 microns. Additionally, the diamond-like coating 133 may exhibit a coefficient of sliding friction of about 0.07-0.08, against dry steel, or as low as about 0.035, against another diamond-like coating, at a relatively high surface pressure (e.g., at surface pressures greater than about 3 GPa).

In some embodiments, the diamond-like coating 133 may be included on a hydrogenated nitrile butadiene rubber (HNBR) seal. In further embodiments, the diamond-like coating 133 may be included on a fluorocarbon elastomer (FKM) seal. In yet further embodiments, the diamond-like coating 133 may be included on a perfluorocarbon elastomer (FFKM) seal. In yet additional embodiments, the diamond-like coating 133 may be included on a face of a mechanical face seal, such as a metal face thereof.

In further embodiments, the bearing assembly may not include such a seal. For example, the bearing assembly may be an open bearing assembly as shown in FIG. 4 and a fluid, such as drilling fluid or air, may be provided through a conduit 150 and directed through the bearing assembly during the operation thereof.

After a diamond-like coating is applied to the bearing surfaces, and optionally, the seal assembly, the bearing assembly 128 may be assembled (FIG. 2).

If bearing inserts are utilized, such as shown in FIG. 2, a radial cone bearing member 122 and an axial cone bearing member 123 may be inserted into each roller cone 106 and coupled thereto. For example, a radial cone bearing member 122 and an axial cone bearing member 123 may be welded to the roller cone 106, such as by one or more of brazing, arc welding, resistance welding, and ultrasonic brazing or welding. In additional embodiments, a radial cone bearing member 122 and an axial cone bearing member 123 may be joined to the roller cone 106 by other methods, such as an interference fit.

Similarly, a radial journal bearing member 124 and an axial journal bearing member 125 may be joined to each bearing pin 116. For example, a radial journal bearing member 124 and an axial journal bearing member 125 may be welded to the bearing pin 116, such as by one or more of brazing, arc welding, resistance welding, and ultrasonic brazing or welding. In additional embodiments, a radial journal bearing member 124 and an axial journal bearing member 125 may be joined to the bearing pin 116 by other methods, such as an interference fit.

If roller bearings are utilized, such as shown in FIG. 4, a roller bearing assembly 140 may be installed on each bearing pin 116", or optionally, be installed within each cone 106".

Additionally, one or more of an elastomer seal, an elastomer seal component, and a mechanical face seal (MFS) may be installed onto one or both of the bearing pins 116 and the roller cones 106 to provide the seal assembly 130 (FIG. 2).

Next, with reference to FIG. 2, a roller cone 106 including a radial cone bearing member 122 and an axial cone bearing member 123 is brought into proximity with and placed over a bearing pin 116 including a radial journal bearing member 124 and an axial journal bearing member 125 such that the bearing pin 116 is inserted into the roller cone 106. The radial cone bearing member 122 is placed over and substantially surrounds the radial journal bearing member 124 such that an inner contact surface of the radial cone bearing 122, which includes a diamond-like coating 131, abuts an outer contact surface of the radial journal bearing member 124, which also includes a diamond-like coating 131, at a first interface 126. In other words, the radial journal bearing member 124 is concentrically nested with the radial cone bearing member 122 such that the outer contact surface of the radial journal bearing member 124 is proximate the inner contact surface of the radial cone bearing member 122. In view of this, the inner contact surface of the radial cone bearing 122, which includes a diamond-like coating 131, is configured to rotate slidably relative to and the outer contact surface of the radial journal bearing member 124, which also includes a diamond-like coating 131, as the roller cone 106 rotates about the bearing pin 116.

Similarly, an inner contact surface of the axial cone bearing member 123, which includes a diamond-like coating 131, abuts an outer contact surface of the axial journal bearing member 125, which also includes a diamond-like coating 131, at a second interface 129 (i.e., an interface between the inner contact surface of the axial cone bearing member 123 and the outer contact surface of the axial journal bearing member 125. In view of this, the inner contact surface of the axial cone bearing member 123, which includes a diamond-like coating 131, is configured to rotate slidably relative to the outer contact surface of the axial journal bearing member 125, which also includes a diamond-like coating 131, as the roller cone 106 rotates about the bearing pin 116.

Finally, the ball bearings 118 are inserted into a receiving ball race and the ball plug 120 inserted to retain the ball bearings 118 in the ball race, and the ball plug 120 is secured in place. Optionally, a lubricant, such as grease, may be inserted into and around the bearing assembly 128.

Figure 5:
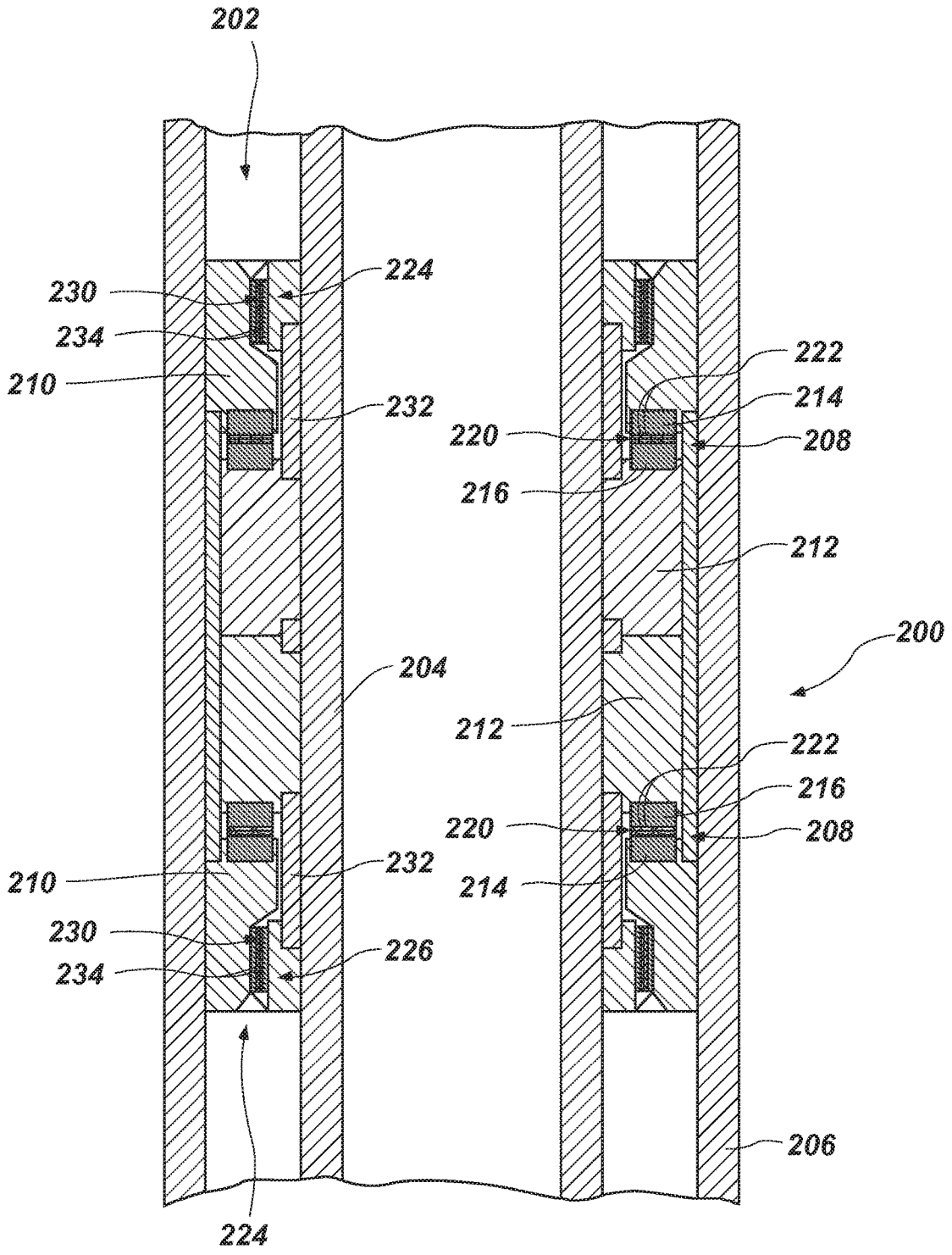
FIG. 5 shows a cross-sectional view of a portion of a downhole motor including a bearing assembly in accordance with an additional embodiment of the present disclosure.
Figure 6:
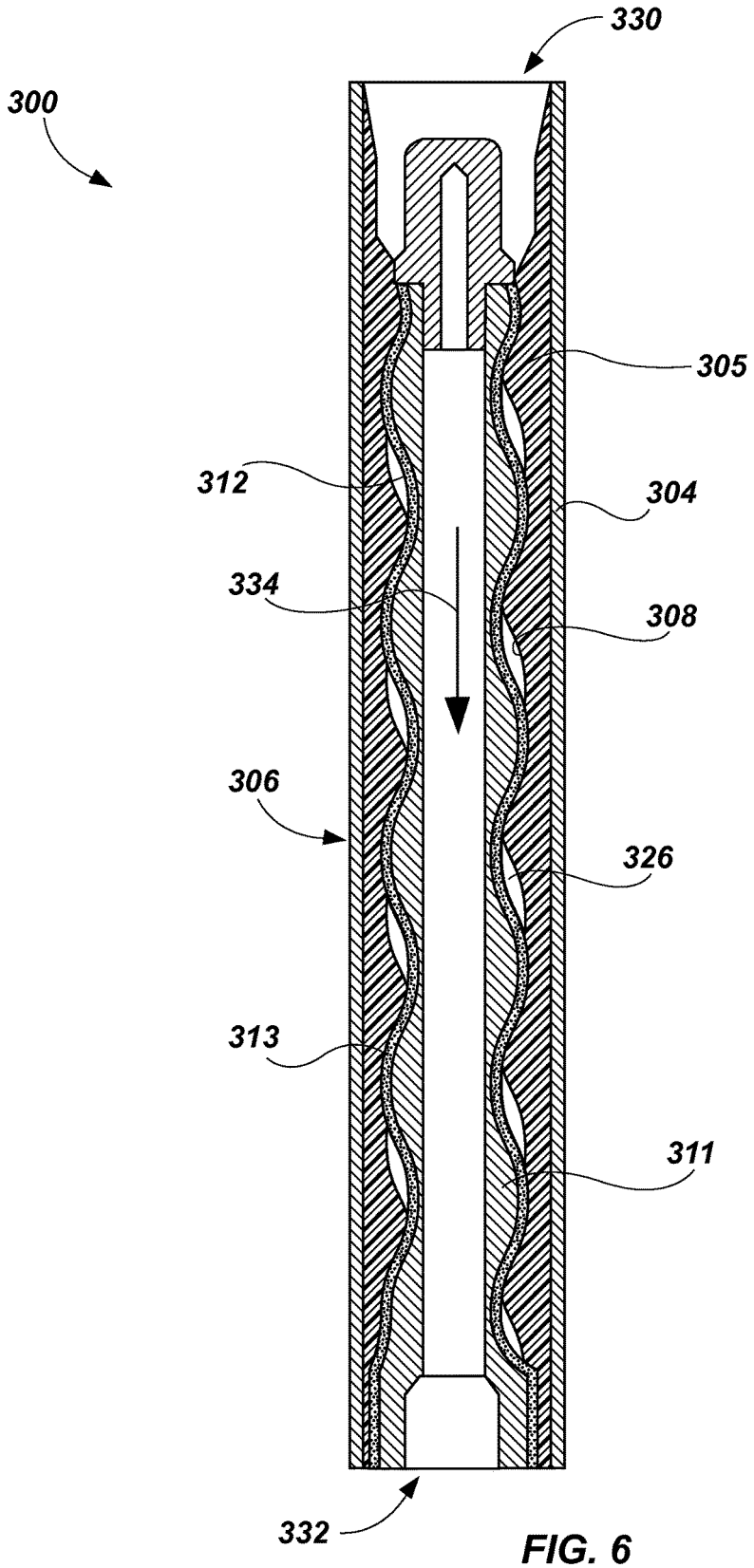
FIG. 6 shows a cross-sectional view of a power section of a downhole motor assembly including a rotor and stator, in accordance with an additional embodiment of the present disclosure.

Although the foregoing mechanical joint was described as being employed in an earth-boring rotary drill bit 100, mechanical joints, including bearings, seals and other structures in accordance with embodiments of the disclosure may be employed in other downhole tools. For example, diamond-like coatings in accordance with the present disclosure may be employed in a downhole motor 200, as shown in FIG. 5. The downhole motor 200 may comprise, for example, a Moineau-type "mud" motor or a turbine motor. The downhole motor 200 includes a bearing assembly 202 in accordance with an embodiment of the present disclosure. A power section, such as is shown in FIG. 6, may be positioned above the bearing assembly 202 and a drill bit, such as shown in FIG. 1, may be positioned below the bearing assembly 202. The downhole motor 200 includes a central tubular downhole motor driveshaft 204 located rotatably within a tubular bearing housing 206, with the downhole motor bearing assembly 202 located and providing for relative rotation between the driveshaft 204 and the housing 206. Those skilled in the art will recognize that the driveshaft 204 may be rotated by the action of a power section 300 (FIG. 6) of the downhole motor 200 and may supply rotary drive to a drill bit, such as the drill bit 100 illustrated in FIG. 1. The housing 206 may remain rotationally stationary during motor operation.

With reference to FIG. 5, the bearing assembly 202 includes at least one axial bearing 208. The bearing assembly 202 may also include two annular axial bearings 208. The axial bearings 208 include a pair of outer bearing rings 210 and a pair of inner bearing rings 212. Each outer bearing ring 210 includes a first axial bearing member 214 and each inner bearing ring 212 includes a second axial bearing member 216. The first axial bearing member 214 abuts against the second axial bearing member 216 at an interface 220. The first and second axial bearing members 214, 216 are configured to rotate slidably against one another and to bear axial loads acting on the downhole motor 200. Like the axial cone and journal bearing members 123, 125 described hereinabove, a diamond-like coating 222 having a hardness above about 4,000 Vickers Hardness (HV) may be applied to the first and second axial bearing members 214, 216. For example, each axial bearing member 214, 216 may include a diamond-like coating 222 over their respective adjoining surfaces (i.e., the surfaces in contact at the interface 220). In some embodiments, the diamond-like coating 222 may have a thickness greater than 10 microns. In further embodiments, the diamond-like coating 222 may have a thickness greater than about 50 microns. In additional embodiments, the diamond-like coating 222 may have a thickness greater than about 100 microns. Additionally, the diamond-like coating 222 may exhibit a coefficient of sliding friction of about 0.07-0.08, against dry steel, or as low as about 0.035, against another diamond-like coating, at a relatively high surface pressure (e.g., at surface pressures greater than about 3 GPa).

The bearing assembly 202 also includes at least one radial bearing 224. In the embodiment shown in FIG. 5, the bearing assembly 202 includes two radial bearings 224. Each radial bearing 224 includes a rotating radial bearing member 226 that runs, at a bearing interface 230, against a portion of the outer bearing ring 210. The radial bearing member 226 is concentrically nested with the outer bearing ring 210, and a spacer ring 232 is concentrically nested with the radial bearing member 226. Like the radial journal and cone bearing members 122 and 124 described hereinabove, a diamond-like coating 234 having a hardness of above 4,000 Vickers Hardness (HV) may be applied to the radial bearing members 224 prior to being coupled to adjacent portions of the downhole motor such as, for example, another component of the bearing assembly 202. For example, each radial bearing member 224 may be provided with a diamond-like coating 234 over at least a portion of a surface thereof. In some embodiments, the diamond-like coating 234 may have a thickness greater than 10 microns. In further embodiments, the diamond-like coating 234 may have a thickness greater than about 50 microns. In additional embodiments, the diamond-like coating 234 may have a thickness greater than about 100 microns. Additionally, the diamond-like coating 234 may exhibit a coefficient of sliding friction between about 0.07-0.08, against dry steel, or as low as about 0.035, against another diamond-like coating, at a relatively high surface pressure (e.g., at surface pressures greater than about 3 GPa).

Referring to FIG. 6, the downhole (FIG. 5) motor 200 also includes a power section 300, which may also benefit from a diamond-like coating. The power section 300 includes an elongated metal housing 304 (which may be coupled to the housing 206 shown in FIG. 5), having therein an elastomeric member 305 which has a helically-lobed inner surface 308. The elastomeric member 305 is secured inside the metal housing 304, usually by bonding the elastomeric member 305 within the interior of the metal housing 304. The elastomeric member 305 and the metal housing 304 together form a stator 306. A rotor 311 is rotatably disposed within the stator 306. In other words, the rotor 311 is disposed within the stator 306 forming a mechanical joint and configured to rotate therein responsive to the flow of drilling fluid through the downhole motor 200, as discussed in further detail below. The rotor 311 includes a helically-lobed outer surface 312 configured to engage with the helically-lobed inner surface 308 of the stator 306. A diamond-like coating 313 may be formed on the outer surface 312 of the rotor 311 as described in greater detail herein.

The outer surface 312 of the rotor 311 and the inner surface 308 of the stator 306 may have similar, but slightly different profiles. For example, the outer surface 312 of the rotor 311 may have one less lobe than the inner surface 308 of the stator 306. The outer surface 312 of the rotor 311 and the inner surface 308 of the stator 306 are configured so that seals are established directly between the rotor 311 and the stator 306 at discrete intervals along and circumferentially around the interface therebetween, resulting in the creation of fluid chambers or cavities 326 between the outer surface 312 of the rotor 311 and the inner surface 308 of the stator 306. The cavities 326 may be filled by a pressurized drilling fluid.

As the pressurized drilling fluid flows from a top 330 to a bottom 332 of the power section 300, in the direction shown by arrow 334, the pressurized drilling fluid causes the rotor 311 to rotate within the stator 306. The number of lobes and the geometries of the outer surface 312 of the rotor 311 and inner surface 308 of the stator 306 may be modified to achieve desired input and output requirements and to accommodate different drilling operations. The rotor 311 may be coupled to a flexible shaft (not shown), and the flexible shaft may be connected to the drive shaft 204 in the bearing assembly 202 (FIG. 5). As previously mentioned, a drill bit may be attached to the drive shaft 204. For example, the drive shaft 204 may include a threaded box, and a drill bit may be provided with a threaded pin that may be engaged with the threaded box of the drive shaft 204.

In some embodiments, a diamond-like coating 313 may be applied to internal surfaces of the downhole motor 200 such as, for example, to at least one of the outer surface 312 of the rotor 311 or the inner surface 308 of the stator 306 of the downhole motor 200.

In particular, the diamond-like coating 313 may be applied to regions of the outer surface 312 of the rotor 311 that are susceptible to erosion caused by the flow of drilling fluid through the downhole motor 200.

While the stator 306 may comprise an elastomeric member 305 that is at least substantially comprised of an elastomeric material, in additional embodiments, the stator 306 may be formed of a metallic material, such as steel. Such metallic stators 306 are described in, for example, U.S. Pat. No. 6,543,132, filed Dec. 17, 1988, issued Apr. 8, 2003, and entitled "Methods of Making Mud Motors," the entire disclosure of which is incorporated herein by this reference.

Figure 7:
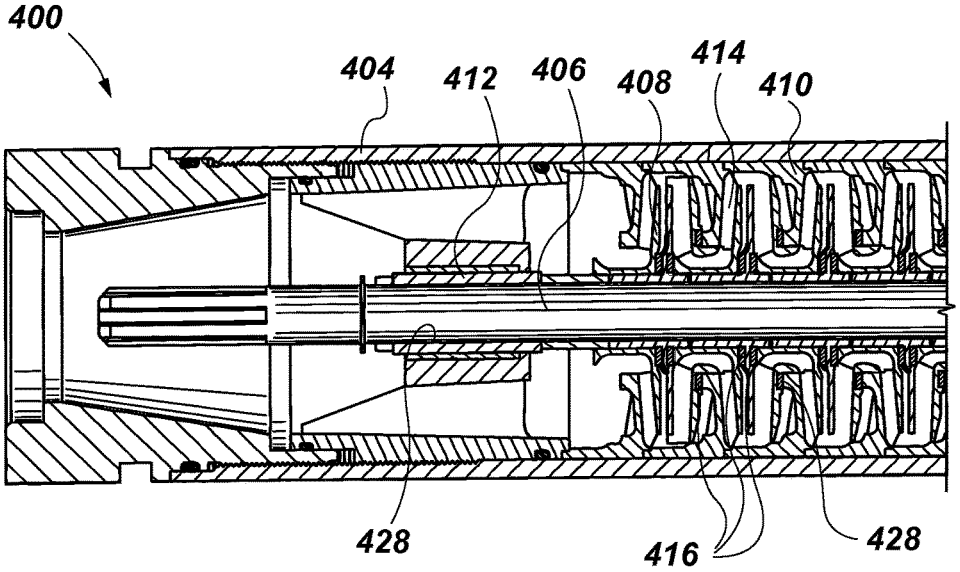
FIG. 7 shows a cross-sectional view of a pumping assembly of a downhole pump, in accordance with an additional embodiment of the present disclosure.
Figure 8:
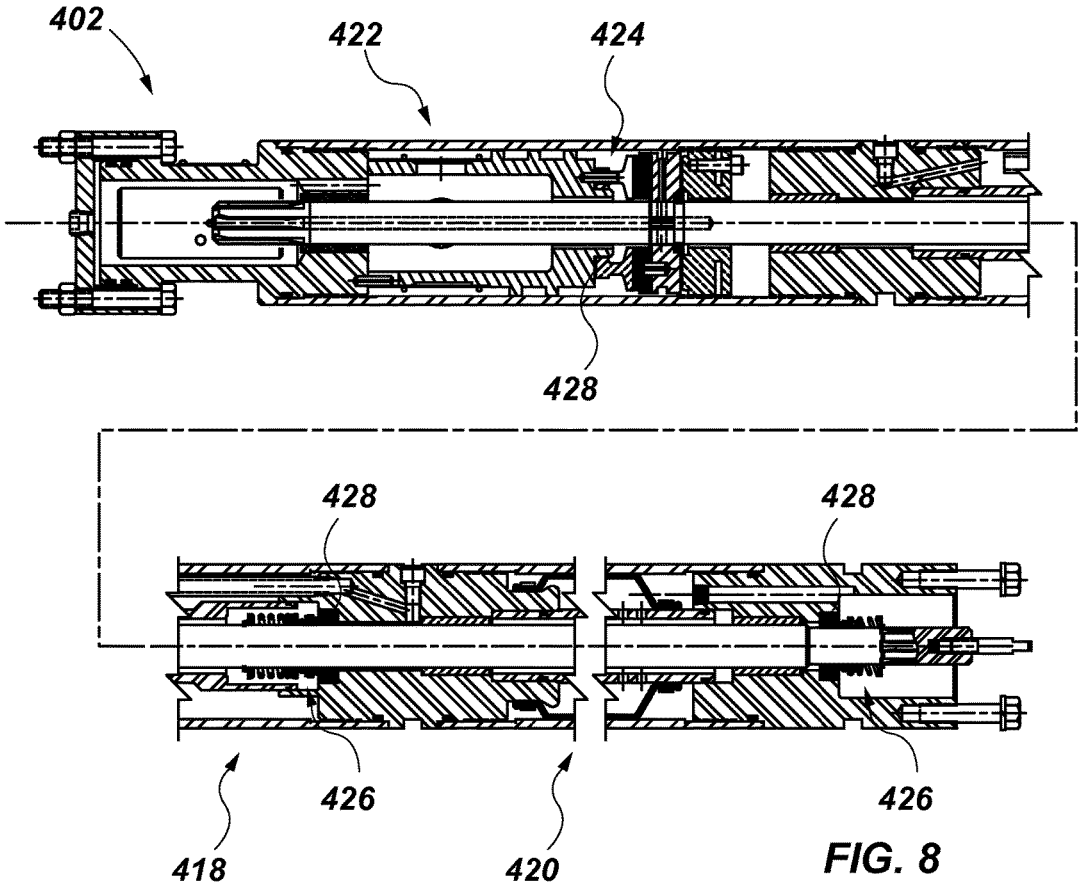
FIG. 8 shows a cross-sectional view of a seal assembly of the downhole pump, in accordance with an additional embodiment of the present disclosure.

In further embodiments, diamond-like coatings in accordance with the present disclosure may be employed in a downhole pump, such as an electric submersible pump (ESP) as shown in FIGS. 7 and 8. The ESP may include a pumping assembly 400, as shown in FIG. 7, and may include a seal assembly 402, as shown in FIG. 8.

Referring to FIG. 7, the pumping assembly 400 may include an outer housing 404, an impeller shaft 406, an impeller 408, and a diffuser 410. The impeller shaft 406 may be rotatably coupled to the housing 404 and maintained in a radial position relative to the housing 404 by one or more radial bearings 412. The impeller 408 may be coupled to the impeller shaft 406 by a key, such that the impeller 408 may rotate with the impeller shaft 406 upon rotation of the impeller shaft 406 relative to the housing 404. The diffuser 410 may be fixably coupled to the housing 404 and may be positioned relative to the impeller 408 such that the impeller 408 and the diffuser 410 define a fluid path 414 therebetween. Additionally, thrust washers 416 may be positioned between the impeller 408 and the diffuser 410 to maintain the axial position of the impeller 408 relative to the diffuser 410. The impeller shaft 406 may be coupled to a motor (not shown), and, upon rotation by the motor, the impeller shaft 406 may rotate the impeller 408 relative to the diffuser 410 and cause fluid to flow through the fluid path 414 between the impeller 408 and the diffuser 410.

Referring the FIG. 8, the ESP may additionally include a seal assembly 402, which may prevent well fluids from entering the motor and allow pressure to equalize between the motor oil and the well fluids. In some embodiments, the seal assembly 402 may be positioned between the motor (not shown) and the pumping assembly 400, providing an area for expansion of the motor oil, equalizing pressure between the well fluid and the motor, isolating the motor oil from the well fluid to prevent contamination, and supporting the thrust load of the impeller shaft 406. The seal assembly 402 may include one or more labyrinth chambers 418 and elastomer bag seals 420. Each labyrinth chamber 418 may include an oil path that reverses its vertical direction twice. Due to the density differences between the motor oil and the well fluid, this arrangement may facilitate the maintenance of the motor oil at the top of the labyrinth chamber 418 and denser well fluids at the bottom of the labyrinth chamber 418. Each elastomer bag seal 420 provides a physical barrier between the motor oil and the well fluid to provide separation of the motor oil and well fluid. In view of this, the elastomer bag seals 420 may maintain the separation of motor oil and well fluid having substantially the same density. However, if the elastomer bag ruptures, the seal may fail. The seal assembly 402 may additionally include a heat exchanger 422, one or more thrust bearings 424, and mechanical seals 426.

The mechanical joints of the ESP may benefit from a diamond-like coating. A diamond-like coating 428 having a hardness above about 4,000 Vickers Hardness (HV) may be applied to surfaces of one or more of the thrust washers 416, the radial bearings 412, thrust bearings 424, the mechanical seals 426 and other components of the mechanical joints of the ESP. In some embodiments, the diamond-like coating 428 may have a thickness greater than 10 microns. In further embodiments, the diamond-like coating 428 may have a thickness greater than about 50 microns. In additional embodiments, the diamond-like coating 428 may have a thickness greater than about 100 microns. Additionally, the diamond-like coating 428 may exhibit a coefficient of sliding friction of about 0.07-0.08 against dry steel, or as low as about 0.035 against another diamond-like coating at a relatively high surface pressure (e.g., at surface pressures greater than about 3 GPa).

One particularly suitable process for applying the diamond-like coating 131, 132, 133, 142, 222, 234, 313, 428 is a process using a precursor gas from which a plasma is produced is disclosed in PCT International Patent Application Number PCT/GB2008/050102, filed Feb. 15, 2008 and published on Aug. 21, 2008 under International Publication Number WO 2008/099220, the disclosure of which is incorporated herein in its entirety by reference. The diamond-like coating 131, 132, 133, 142, 222, 234, 313, 428 may also be characterized as predominantly (>85%) an amorphous form of sp3 carbon.

The aforementioned coating process has been implemented for certain applications by Diamond Hard Surfaces Ltd. of Oxford, Oxfordshire, Great Britain. However, the application of the coating process, which results in a coating trademarked as ADAMANT® coating, has not been suggested for the application of the present disclosure. It is currently believed that a coating known as the ADAMANT® 050 coating, or an even more robust implementation of same, may be especially suitable for use in the application of the present disclosure. The coating process may be conducted at temperatures of 100° C. or less, and such diamond-like coating of a desired thickness of 100 microns or more, depending on the material of the substrate to be coated, may be achieved at temperatures well below 200° C. In addition, these coatings exhibit excellent adhesion to the surface of the coated substrate, as well as high conformality and evenness of coverage.

To deposit the diamond-like coating on a component for a downhole tool, the component may be positioned in a vacuum chamber that includes a cathode and an anode. A uniform magnetic field (e.g., in the range of about 10 mT to about 200 mT) is then produced between the cathode and the component to be coated (which acts as a second cathode) such as by permanent magnets. After the vacuum chamber is evacuated, an inert etching gas, such as one or more of krypton, argon, and neon, may be introduced into the vacuum chamber.

After etching is complete, a hydrocarbon gas may be directed into the vacuum chamber and a hydrocarbon plasma may be formed within the magnetic field, utilizing an unpulsed direct current bias voltage (e.g., a voltage between about 0.5 KV to about 4.5 KV). The hydrocarbon plasma may be formed in an aperture of the anode, which may have an aspect ratio greater than 1:2 (depth to width). For example, the aspect ratio of the aperture of the anode may be greater than 1:50. In some embodiments, the aspect ratio of the aperture may be 1:3000, and the aspect ratio may depend upon the size of the component to be coated. Carbon atoms may then be deposited directly onto surfaces of the component to be coated, and the uniform magnetic fields effect on the plasma ions facilitates a uniform depositing of the coating on the surfaces of the component.

Optionally, a second anode may be positioned on the opposite side of the component, which may enable both sides of the component to be coated with the diamond-like coating.

To coat the interior surfaces of a component, such as the interior surfaces of a roller cone 106, an anode may be positioned inside a cavity of the roller cone 106. Additionally, magnets may be positioned outside of the roller cone 106 to produce a magnetic field orthogonal to the surface to be coated. As the hydrocarbon plasma is produced and the carbon atoms are deposited on the surface of the roller cone 106, the roller cone 106 may be rotated relative to the anode and the magnetic field to deposit an even diamond-like coating over the interior surface of the roller cone 106.

Similarly, to coat the curved exterior of a component, such as the exterior of a bearing pin 116, the component may be rotated relative to the anode and the magnetic field as the hydrocarbon plasma is produced and the carbon atoms are deposited on the surface of the component.

In some embodiments, a sublayer may be deposited on a component of a downhole tool, prior to depositing a diamond-like coating. For example, the component may be deposited into a vacuum chamber and a sputter ion pump may sputter metal ions onto the surface of the component to form the sublayer. In some embodiments, a sublayer comprising one or more of titanium, magnesium, and aluminum may be deposited on the component to be coated. As a non-limiting example, the sublayer may have a thickness of about 0.01 microns. After the sublayer is formed, a diamond-like coating may be deposited over the sublayer.

An advantage of these processes for forming diamond-like coatings is that they can be carried out at temperatures less than about 140° C. If the article to be coated has previously undergone hardness or heat treatment work, having to use a higher temperature to apply the diamond-like coating could interfere with this previous work. This may be especially important when coating steels, where temperatures of about 120° C. to about 160° C. can be the starting range for affecting the crystal structure of the metals. Most other coating methods are carried out at high temperatures well above 200° C., such as temperatures of about 300° C. and higher, but this can lead to internal stress and cracking of the coating particularly when the trying to increase the thickness of the coating. Carrying out the deposition at lower temperatures helps prevent the development of internal stress in the coatings. Furthermore, tempered steel components may be coated below the tempering temperature, thus retaining the desired material properties of the underlying steel component. Additionally, the devices and methods described may achieve a relatively thick coating at a temperature substantially under 200° C., whereby previously only relatively thin coatings have been achieved using temperatures below 200° C.

Using the devices and methods described herein for coating a substrate enables a thickness of greater than 100 microns to be obtained, depending on the substrate, and a hardness of above 4,000 Vickers Hardness (HV). This is surprising, as coatings using previous methods typically do not obtain coatings greater than about 2-5 microns as the coatings tend to debond from the surface as the coating becomes thicker. However processes as described herein are able to achieve coatings of greater than 50 microns. Additionally, a diamond-like coating according to an embodiment of the disclosure may exhibit a coefficient of sliding friction of about 0.07-0.08, against dry steel, or as low as about 0.035, against another diamond-like coating, at a relatively high surface pressure (e.g., at surface pressures greater than about 3 GPa) can be obtained. The thicker coating provides a combination of relatively high load bearing with relatively low coefficient of friction.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventors.

What is claimed is:

1. A rotary roller cone bit comprising:

a bit body comprising at least one leg having a bearing pin;

a roller cone overlying the bearing pin;

a bearing assembly disposed on the bearing pin away from a base of the bearing pin and configured to bear a drilling load, the bearing assembly comprising:

a radial journal bearing member affixed within a recess in the bearing pin and comprising a first diamond-like coating on an outer contact surface thereof;

a radial cone bearing member affixed within a recess in the roller cone and comprising a second diamond-like coating on an inner contact surface thereof, the second diamond-like coating of the radial cone bearing member abutting the first diamond-like coating of the radial journal bearing member;

an axial journal bearing member affixed within another recess in the bearing pin and comprising a third diamond-like coating on an outer contact surface thereof; and an axial cone bearing member affixed within another recess in the roller cone and comprising a fourth diamond-like coating on an inner contact surface thereof, the fourth diamond-like coating abutting the third diamond-like coating of the axial journal bearing member; and a seal assembly configured and positioned to seal the bearing assembly and comprising a seal having a fifth diamond-like coating on a surface thereof, the seal selected from the group consisting of a hydrogenated nitrile butadiene rubber seal, a fluorocarbon elastomer seal, and a perfluorocarbon elastomer seal;

wherein each of the first diamond-like coating of the radial journal bearing member, the second diamond-like coating of the radial cone bearing member, the third diamond-like coating of the axial journal bearing member, the fourth diamond-like coating of the axial cone bearing member, and the fifth diamond-like coating of the seal of the seal assembly individually comprises greater than or equal to about 85 percent amorphous sp3 carbon, individually exhibits a thickness between 10 micrometers and about 100 micrometers, and individually has a coefficient of sliding friction of about 0.07 to 0.08 against dry steel.

2. The rotary roller cone bit of claim 1, wherein each of the first diamond-like coating of the radial journal bearing member, the second diamond-like coating of the radial cone bearing member, the third diamond-like coating of the axial journal bearing member, and the fourth diamond-like coating of the axial cone bearing member individually exhibits a thickness between about 50 micrometers and about 100 micrometers.

3. The rotary roller cone bit of claim 1, wherein each of the first diamond-like coating of the radial journal bearing member, the second diamond-like coating of the radial cone bearing member, the third diamond-like coating of the axial journal bearing member, and the fourth diamond-like coating of the axial cone bearing member individually exhibits a coefficient of sliding friction of about 0.035 against another diamond-like coating.

4. The rotary roller cone bit of claim 1, wherein each of the first diamond-like coating of the radial journal bearing member, the second diamond-like coating of the radial cone bearing member, the third diamond-like coating of the axial journal bearing member, and the fourth diamond-like coating of the axial cone bearing member individually comprises a bearing surface of the bearing assembly.

5. The rotary roller cone bit of claim 1, wherein the seal is selected from the group consisting of a fluorocarbon elastomer seal, and a perfluorocarbon elastomer seal.

6. The rotary roller cone bit of claim 1, wherein the seal comprises a mechanical face seal.

7. The rotary roller cone bit of claim 1, further comprising one or more of:

a first sublayer comprising magnesium between the first diamond-like coating and the outer contact surface of the radial journal bearing member;

a second sublayer comprising magnesium between the second diamond-like coating and the inner contact surface of the radial cone bearing member;

a third sublayer comprising magnesium between the third diamond-like coating and the outer contact surface of the axial journal bearing member; and a fourth sublayer comprising magnesium between the fourth diamond-like coating and the inner contact surface of the axial cone bearing member.

* * * * *